US008636555B2

(12) United States Patent
Kure et al.

(10) Patent No.: US 8,636,555 B2
(45) Date of Patent: Jan. 28, 2014

(54) MANUFACTURING APPARATUS AND MANUFACTURING METHOD FOR SPARK PLUGS

(75) Inventors: Keisuke Kure, Inuyama (JP); Jiro Kyuno, Kiyosu (JP)

(73) Assignee: NGK Spark Plug Co., Ltd., Aichi (JP)

( * ) Notice: Subject to any disclaimer, the term of this patent is extended or adjusted under 35 U.S.C. 154(b) by 116 days.

(21) Appl. No.: 13/256,855

(22) PCT Filed: Jun. 7, 2010

(86) PCT No.: PCT/JP2010/003775
§ 371 (c)(1),
(2), (4) Date: Sep. 15, 2011

(87) PCT Pub. No.: WO2011/013287
PCT Pub. Date: Feb. 3, 2011

(65) Prior Publication Data

US 2012/0001532 A1 Jan. 5, 2012

(30) Foreign Application Priority Data

Jul. 29, 2009 (JP) ..... 2009-176710

(51) Int. Cl.
*H01T 21/02* (2006.01)

(52) U.S. Cl.
USPC ..... 445/7; 445/66; 313/118; 313/143; 313/145

(58) Field of Classification Search
USPC ..... 313/118, 132, 137, 143, 145; 445/7, 66
See application file for complete search history.

(56) References Cited

U.S. PATENT DOCUMENTS

| | | | | |
|---|---|---|---|---|
| 6,357,274 | B1 | 3/2002 | Tanaka et al. | |
| 2002/0000765 | A1 * | 1/2002 | Suzuki | 313/141 |
| 2005/0093414 | A1 * | 5/2005 | Downs et al. | 313/141 |
| 2006/0076865 | A1 * | 4/2006 | Shibata et al. | 313/143 |
| 2007/0046162 | A1 | 3/2007 | Moribe et al. | |
| 2007/0290590 | A1 * | 12/2007 | Hoffman | 313/141 |
| 2008/0218053 | A1 * | 9/2008 | Callahan et al. | 313/143 |
| 2008/0284305 | A1 * | 11/2008 | Hoffman | 313/141 |

FOREIGN PATENT DOCUMENTS

| | | | |
|---|---|---|---|
| JP | 49-72531 | A | 7/1974 |
| JP | 08-306468 | A | 11/1996 |
| JP | 10-032077 | A | 2/1998 |
| JP | 2006-079954 | A | 3/2006 |
| JP | 2007-080638 | A | 3/2007 |
| JP | 2007-258142 | A | 10/2007 |

OTHER PUBLICATIONS

Extended European Search Report dated Aug. 5, 2013 for corresponding European Patent Application No. EP 10 80 4040.

* cited by examiner

*Primary Examiner* — Anh Mai
*Assistant Examiner* — Kevin Quarterman
(74) *Attorney, Agent, or Firm* — Sughrue Mion, PLLC

(57) ABSTRACT

Provided is a technique for limiting the radial displacement between a metal shell and an insulator in a spark plug. At the time of manufacturing a spark plug with a metal shell and an insulator, the metal shell and the insulator are assembled together by, while allowing relative positional displacement between the metal shell and the insulator in an axial direction (O-O), limiting relative positional displacement between the metal shell and the insulator in a radial direction intersecting with the axial direction in such a manner that the amount of deviation between an axis of the metal shell and an axis of the insulator becomes less than or equal to a predetermined level.

17 Claims, 8 Drawing Sheets

FIG. 1

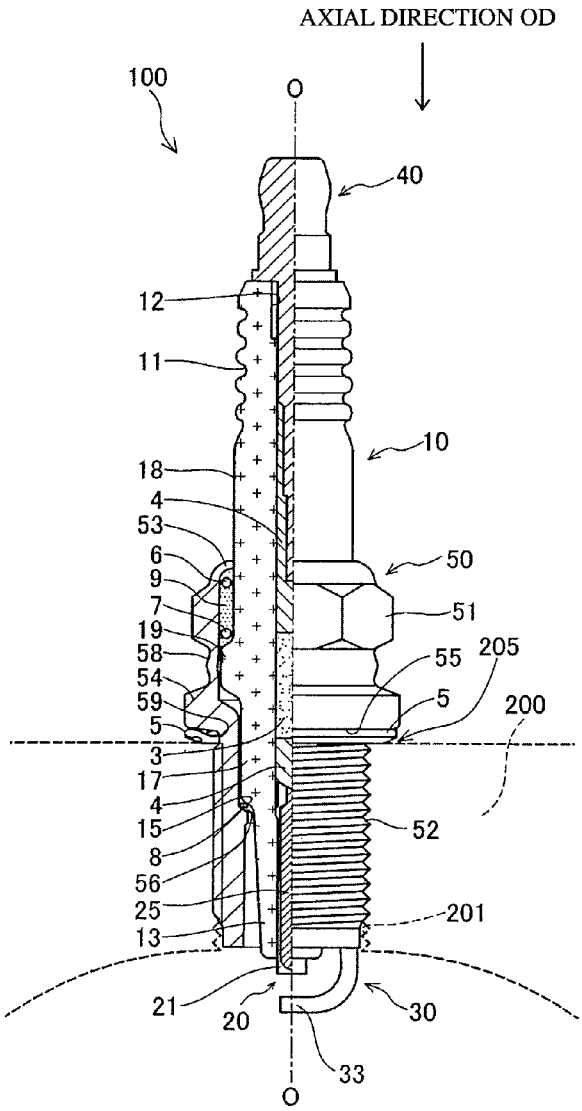

| | |
|---|---|
| 3: | Ceramic resistor |
| 4: | Seal member |
| 5: | Gasket |
| 6,7: | Ring member |
| 8: | Plate packing |
| 9: | Talc |
| 10: | Ceramic insulator |
| 11: | Knurls |
| 12: | Axial hole |
| 13: | Leg portion |
| 15: | Step portion |
| 17: | Front body portion |
| 18: | Rear body portion |
| 19: | Flange portion |
| 20: | Center electrode |
| 21: | Electrode body |
| 25: | Core |
| 30: | Ground electrode |
| 33: | Front end portion |
| 40: | Metal terminal |
| 50: | Metal shell |
| 51: | Tool engagement portion |
| 52: | Mounting thread portion |
| 53: | Crimped portion |
| 54: | Seal portion |
| 55: | Bearing surface |
| 56: | Step portion |
| 58: | Buckled portion |
| 59: | Thread neck |
| 100: | Spark plug |
| 102: | Inner-shaft-attached insulator |
| 200: | Engine head |
| 201: | Mounting thread hole |
| 205: | Opening edge |

FIG. 4

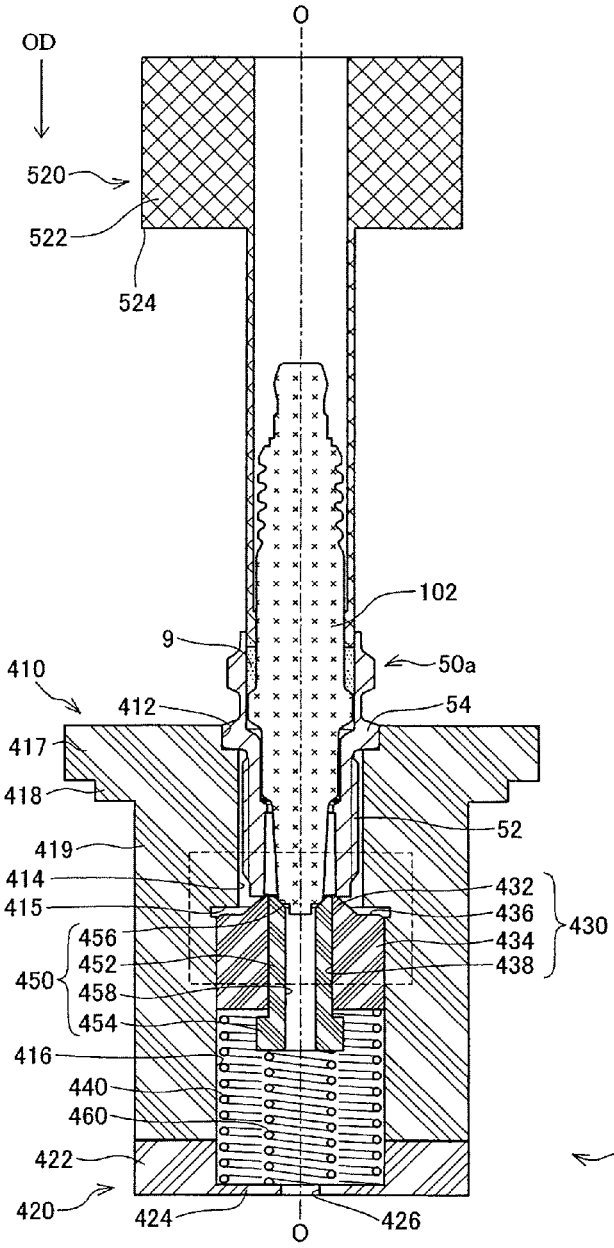

| | |
|---|---|
| 9: | Talc |
| 50a: | Unfinished metal shell |
| 51: | Tool engagement portion |
| 52: | Mounting thread portion |
| 54: | Seal portion |
| 102: | Inner-shaft-attached insulator |
| 400: | Assembling seat |
| 410: | Receiving die |
| 412: | Shell receiving portion |
| 414: | Insertion portion |
| 415: | Lower end face |
| 416: | Guide hole |
| 417, 418: | Flange portion |
| 419: | Body portion |
| 420: | Seat bottom |
| 422: | Annular portion |
| 424: | Plate portion |
| 426: | Through hole |
| 430: | Shell restriction member |
| 432: | Tapered portion |
| 434: | Body portion |
| 436: | Upper end face |
| 438: | Guide hole |
| 440: | Outer spring |
| 450: | Insulator restriction member |
| 452: | Body portion |
| 454: | Flange portion |
| 456: | Tapered hole: |
| 458: | Through hole |
| 460: | Inner spring |
| 520: | Press jig |
| 522: | Large-diameter portion |
| 524: | Front end |

FIG. 6

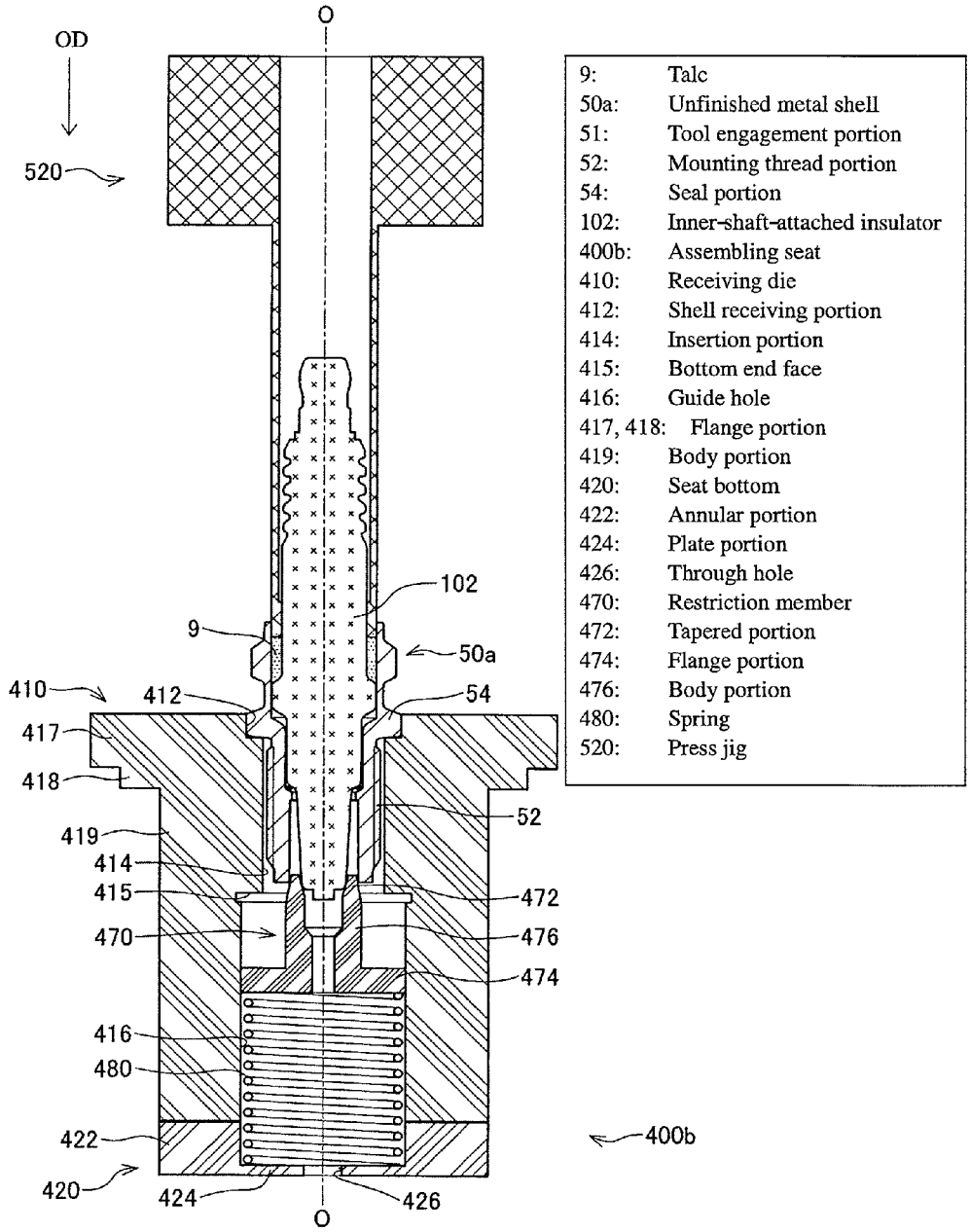

| | |
|---|---|
| 9: | Talc |
| 50a: | Unfinished metal shell |
| 51: | Tool engagement portion |
| 52: | Mounting thread portion |
| 54: | Seal portion |
| 102: | Inner-shaft-attached insulator |
| 400b: | Assembling seat |
| 410: | Receiving die |
| 412: | Shell receiving portion |
| 414: | Insertion portion |
| 415: | Bottom end face |
| 416: | Guide hole |
| 417, 418: | Flange portion |
| 419: | Body portion |
| 420: | Seat bottom |
| 422: | Annular portion |
| 424: | Plate portion |
| 426: | Through hole |
| 470: | Restriction member |
| 472: | Tapered portion |
| 474: | Flange portion |
| 476: | Body portion |
| 480: | Spring |
| 520: | Press jig |

MANUFACTURING APPARATUS AND MANUFACTURING METHOD FOR SPARK PLUGS

CROSS REFERENCE TO RELATED APPLICATIONS

This application is a National Stage of International Application No. PCT/JP2010/003775 filed Jun. 7, 2010, claiming priority based on Japanese Patent Application No. 2009-176710 filed Jul. 29, 2009, the contents of all of which are incorporated herein by reference in their entirety.

TECHNICAL FIELD

The present invention relates to a technique for manufacturing a spark plug.

BACKGROUND ART

A spark plug for an internal combustion engine is known, which includes a metal shell formed with a tool engagement portion and a mounting thread portion, a ceramic insulator (insulator) inserted in a through hole of the metal shell in an axial direction, a center electrode fixed in the ceramic insulator and a ground electrode fixed to a front end portion of the metal shell so that the spark plug can generate a spark discharge between a front end portion of the center electrode and the ground electrode.

PRIOR ART DOCUMENTS

Patent Documents

Patent Document 1:
Japanese Laid-Open Patent Publication No. H10-32077
Patent Document 2:
Japanese Laid-Open Patent Publication No. 2007-80638
Patent Document 3:
Japanese Laid-Open Patent Publication No. H8-306468
Patent Document 4:
Japanese Laid-Open Patent Publication No. 2006-79954

DISCLOSURE OF THE INVENTION

Problems to be Solved by the Invention

There has recently been a demand to reduce the diameter of the spark plug for improvement in the design flexibility of the internal combustion engine. As the diameter of the spark plug is made smaller, the inner diameter of the front end portion of the metal shell is decreased. On the other hand, it is difficult to decrease the outer diameter of the center electrode to an extremely small size because the center electrode, to which a high voltage is applied, has limitations on its electrical or mechanical properties. The diameter reduction of the spark plug thus leads to a smaller distance between the front end portion of the center electrode and the front end portion of the metal shell. In such a case, there arises a problem that the spark plug may generate a spark discharge between the front end portion of the metal shell and the center electrode as the minimum distance between the center electrode and the metal shell decreases with increase in the amount of deviation between an axis of the ceramic insulator and an axis of the metal shell. This problem applies to various cases including not only the case where the diameter of the spark plug is reduced but also the case where the distance between the center electrode and the ground electrode (the spark gap) is increased.

The present invention has been made to solve the above conventional problems. It is an object of the present invention to provide a technique for reducing the amount of deviation between an axis of a metal shell and an axis of an insulator in a spark plug.

Means for Solving the Problems

The present invention can be realized as the following embodiments or application examples to solve at least part of the above problems.

Application Example 1

A manufacturing method of a spark plug, the spark plug comprising: a center electrode; an insulator having an axial hole extending in an axial direction of the center electrode and retaining the center electrode in a front side of the axial hole in the axial direction; and a cylindrical metal shell surrounding and retaining therein the insulator, the manufacturing method comprising: assembling the insulator in the metal shell by inserting the insulator from an open rear end of the metal shell in the axial direction, wherein the assembling of the metal shell and the insulator includes limiting relative positional displacement between the metal shell and the insulator in a radial direction intersecting with the axial direction in such a manner that the amount of deviation between an axis of the metal shell and an axis of the insulator becomes less than or equal to a predetermined level, while allowing relative positional displacement between the metal shell and the insulator in the axial direction.

Application Example 2

The manufacturing method of the spark plug according to Application Example 1, wherein the limiting includes: providing a first positioning member; bringing a front end portion of the metal shell in the axial direction into contact with the first positioning member to thereby limit displacement of the metal shell in the radial direction; providing a second positioning member movable relative to the first positioning member along the axial direction; and bringing a front end portion of the insulator in the axial direction into contact with the second positioning member to thereby limit displacement of the insulator in the radial direction.

Application Example 3

The manufacturing method of the spark plug according to Application Example 2, wherein the first positioning member has a first tapered surface that increases in outer diameter toward the front in the axial direction; wherein the second positioning member has a second tapered surface that decreases in inner diameter toward the front in the axial direction; and wherein the front end portion of the metal shell and the front end portion of the insulator are brought into contact with the first and second tapered surfaces, respectively.

Application Example 4

The manufacturing method of the spark plug according to Application Example 3, wherein at least one of the first and second tapered surfaces is conical in shape.

Application Example 5

The manufacturing method of the spark plug according to any one of Application Examples 2 to 4, wherein the second positioning member is formed of a resin.

Application Example 6

The manufacturing method of the spark plug according to any one of Application Examples 2 to 5, wherein the first and second positioning members are biased by elastic members toward the rear in the axial direction.

Application Example 7

The manufacturing method of the spark plug according to Application Example 6, wherein the elastic members are springs.

Application Example 8

The manufacturing method of the spark plug according to any one of Application Examples 1 to 7, wherein the assembling includes filling a talc in a space between the metal shell and the insulator and pressing the talc toward the front in the axial direction.

Application Example 9

The manufacturing method of the spark plug according to any one of Application Examples 1 to 7, wherein the assembling includes crimping the open rear end of the metal shell to thereby retain the insulator in the metal shell.

The present invention can be embodied in various forms such as a spark plug manufacturing apparatus and manufacturing method and a spark plug manufactured by the manufacturing apparatus or manufacturing method.

Effects of the Invention

In the spark plug manufacturing method of Application Example 1, the relative positional displacement between the metal shell and the insulator in the axial direction is allowed during the assembling of the metal shell and the insulator. Even when there is an error in the shape of the spark plug structural component such as the metal shell or the insulator in the axial direction, it is possible to limit the relative positional displacement between the metal shell and the insulator in the radial direction properly and reduce the amount of deviation between the axis of the metal shell and the axis of the insulator to a smaller level.

In the spark plug manufacturing method of Application Example 2, the first and second positioning members are provided so as to be movable relative to each other in the axial direction. As the front end portion of the metal shell and the front end portion of the insulator are brought into contact with the first and second positioning members, respectively, it is possible to limit the relative positional displacement between the metal shell and the insulator in the radial direction while allowing the relative positional displacement between the metal shell and the insulator in the axial direction more easily.

In the spark plug manufacturing method of Application Example 3, it is possible to limit the relative positional displacement between the metal shell and the insulator in the radial direction still more easily by contact of the front end portion of the metal shell and the front end portion of the insulator with the first and second tapered surfaces of the first and second positioning members, respectively.

In the spark plug manufacturing method of Application Example 4, it is possible to allow easy production of the positioning member as the tapered surface is made conical in shape.

In the spark plug manufacturing method of Application Example 5, it is possible to prevent contamination of the insulator as the second positioning member, with which the insulator is brought into contact, is formed of a resin.

In the spark plug manufacturing method of Application Example 6, it is possible to limit the relative positional displacement between the metal shell and the insulator in the radial direction more easily by biasing the first and second positioning members toward the rear in the axial direction.

In the spark plug manufacturing method of Application Example 7, it is possible to bias the positioning member easily with the use of the spring as the elastic member.

In the spark plug manufacturing method of Application Example 8, it is possible to limit the relative positional relationship between the metal shell and the insulator in the radial direction more easily as the talc is pressed toward the front in the axial direction to thereby apply a load to the insulator toward the front.

In the spark plug manufacturing method of Application Example 9, it is possible to limit the relative positional relationship between the metal shell and the insulator in the radial direction more easily as the open rear end of the metal shell is crimped to thereby apply a load to the insulator toward the front.

BRIEF DESCRIPTION OF THE DRAWING

FIG. 1 is a partially section view showing one example of spark plug manufactured according to the present invention.

FIG. 4 is an enlarged section view of an assembling seat and a press jig of the assembling apparatus.

FIG. 6 is a process chart showing a process step for assembling an inner-shaft-attached insulator into an unfinished metal shell by means of an assembling seat according to a comparative example.

BEST MODES FOR CARRYING OUT THE INVENTION

A. First Embodiment

A1. Structure of Spark Plug

Figure 2:
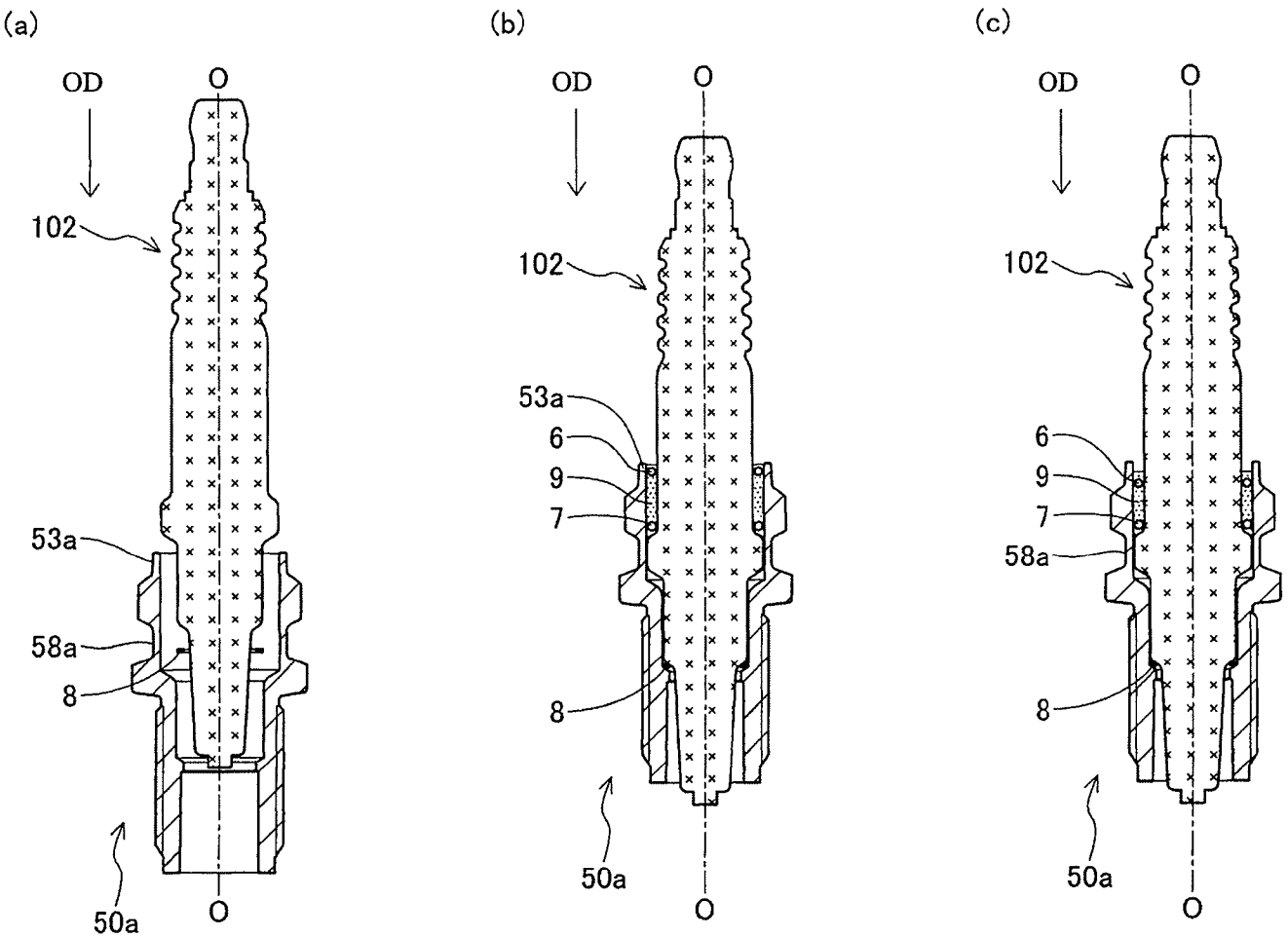
FIG. 2 is a process chart showing a part of a manufacturing process of the spark plug.

FIG. 1 is a partially section view of a spark plug 100 that can be manufactured according to the present invention. In the following description, the axial direction OD of the spark plug 100 is set to the vertical direction in FIG. 1; and the lower and upper sides in FIG. 1 are referred to as front and rear sides of the spark plug 100, respectively. The right side of the axis O-O in FIG. 1 shows an appearance of the spark plug 100, whereas the left side of the axis O-O in FIG. 1 shows a cross section of the spark plug 100 taken through the axis O-O (central axis).

The spark plug 100 has a ceramic insulator 10 as an insulator formed of sintered alumina etc. The ceramic insulator 10 is cylindrical in shape. An axial hole 12 is formed in the ceramic insulator 10 along the central axis so as to extend in the axial direction OD. The ceramic insulator 10 includes a flange portion 19 formed substantially at the center thereof in the axial direction OD and having the largest outer diameter, a rear body portion 18 formed on a rear side of the flange portion 19 and having knurls 11 to increase in surface length for insulation performance improvement, a front body portion 17 formed on a front side of the flange portion 19 and having an outer diameter smaller than that of the rear body portion 18, and a leg portion 13 formed on a front side of the front body portion 17 and having an outer diameter smaller than that of the front body portion 17. The leg portion 13 decreases in outer diameter toward the front and, when the spark plug 100 is mounted on an engine head 200 of an internal combustion engine, gets exposed to the inside of a combustion chamber of the internal combustion engine. The ceramic insulator 10 also includes a step portion 15 between the leg portion 13 and the front end portion 17.

The spark plug 100 has a center electrode 20 retained in a front side of the axial hole 12 of the ceramic insulator 10 such that the center electrode 20 extends from the front side toward the rear side of the ceramic insulator 10 along the central axis O-O with a front end portion of the center electrode 20 protruding from a front end of the ceramic insulator 10. The center electrode 20 is rod-shaped and has an electrode body 21 and a core 25 embedded in the electrode body 21. The electrode body 21 is formed of nickel or a nickel-based alloy such as Inconel 600 or 601 (trademark). The core 25 is formed of copper or a copper-based alloy having a higher thermal conductivity than that of the electrode body 21. In general, the center electrode 20 is produced by forming the electrode body 21 into a bottomed cylindrical shape, fitting the core 25 in the electrode body 21, and then, extruding the resulting material from the bottom side. The core 25 has a body portion substantially uniform in outer diameter and a front end portion tapering down to the front. The spark plug 100 also has a metal terminal 40 retained in a rear side of the axial hole 12 of the ceramic insulator 10 and electrically connected with the center electrode 20 through a ceramic resistor 3 and seal members 4. Herein, the center electrode 20, the seal members 4, the ceramic resistor 3 and the metal terminal 40 are referred to in combination as an "inner shaft"; and the ceramic insulator 10 to which the center electrode 20, the seal elements 4, the ceramic resistor 3 and the metal terminal 40 (as the electrode shaft) have been attached is referred to as an "inner-shaft-attached insulator 102".

The spark plug 100 has a metal shell 50 as a cylindrical metal fitting formed of low carbon steel etc. The metal shell 50 retains therein the ceramic insulator 10 by surrounding some region of the ceramic insulator 10 from part of the rear body portion 18 through to the leg portion 13.

The metal shell 50 includes a tool engagement portion 51 and a mounting thread portion 52. The tool engagement portion 51 is engaged with a spark plug wrench (not shown). The mounting thread portion 52 is formed with screw threads and screwed into a mounting thread hole 201 of the engine head 200 on the top of the internal combustion engine. The spark plug 100 is fixed to the engine head 200 of the internal combustion engine by screw engagement of the mounting thread portion 52 of the metal shell 50 in the mounting thread hole 201 of the engine head 200.

The metal shell 50 also includes a flanged seal portion 54 between the tool engagement portion 51 and the mounting thread portion 52. An annular gasket 5 formed by bending a plate material is fitted on a thread neck 59 between the mounting thread portion 52 and the seal portion 54 and, when the spark plug 100 is mounted on the engine head 200, crushed and deformed between a bearing surface 55 of the seal portion 54 and an opening edge 205 of the mounting thread hole 201 so as to establish a seal between the spark plug 100 and the engine head 200 and prevent combustion gas leakage through the mounting thread hole 201.

Further, the metal shell 50 includes a thin crimped portion 53 formed on a rear side of the tool engagement portion 51 and a thin buckled portion 58 formed between the tool engagement portion 51 and the seal portion 54 in the same manner as the crimped portion 53. Annular ring members 6 and 7 are interposed between an outer peripheral surface of the rear body portion 18 of the ceramic insulator 10 and inner peripheral surfaces of the tool engagement portion 51 and crimped portion 53 of the metal shell 50. A talc powder (talc) 9 is filled between these ring members 6 and 7. The crimped portion 53 is bent inwardly by crimping a rear end of the metal shell 50 so as to fix the metal shell 50 and the ceramic insulator 10 together. An annular plate packing 8 is held between the step portion 15 of the ceramic insulator 10 and a step portion 56 of the inner peripheral surface of the metal shell 50 to keep gastightness between the metal shell 50 and the ceramic insulator 10 and prevent combustion gas leakage. The buckled portion 58 is adapted to get bent and deformed outwardly with the application of a compression force during crimping so as to increase the compression length of the talc 9 and improve the gastightness of the metal shell 50.

The spark plug 100 has a ground electrode 30 joined to a front end portion of the metal shell 50 and bent toward the central axis O-O. The ground electrode 30 is formed of a high-corrosion-resistance nickel alloy such as Inconel 600 (trademark). The joining of the ground electrode 30 and the metal shell 50 can be done by welding. The ground electrode 30 includes a front end portion 33 facing the center electrode 20.

Although not shown in the drawing, a high-voltage cable is connected to the metal terminal 40 through a plug cap (not shown) so as to apply a high voltage between the metal terminal 40 and the engine head 20 through the high-voltage cable for the generation of a spark discharge between the ground electrode 30 and the center electrode 20.

For improvement in spark wear resistance, an electrode tip containing a high-melting noble metal as a main component is attached to each of the center electrode 20 and the ground electrode 30 although omitted from FIG. 1. More specifically, the electrode tip formed of iridium (Ir) or an iridium-based alloy containing one kind or two or more kinds of additive elements selected from platinum (Pt), rhodium (Rh), ruthenium (Ru), palladium (Pd) and rhenium (Re) is attached to a front end face of the center electrode 20. The electrode tip formed of platinum or a platinum-based alloy is attached to a surface of the front end portion 33 of the ground electrode 30 facing the center electrode 20.

A2. Manufacturing Process of Spark Plug

FIG. 2 is a process chart showing a part of a manufacturing process of the spark plug 100 (FIG. 1) according to a first embodiment of the present invention. In the manufacturing process of FIG. 2, an inner-shaft-attached insulator 102 and an unfinished metal shell 50*a* are first prepared. The unfinished metal shell 50*a* has cylindrical portions 53*a* and 58*a* to be formed into the crimped portion 53 and the buckled portion 58 of the metal shell 50 (FIG. 1), respectively.

As shown in FIG. 2(*a*), the plate packing 8 and the inner-shaft-attached insulator 102*a* are inserted in this order into the unfinished metal shell 50*a* in the axial direction OD. After the insertion of the inner-shaft-attached insulator 102 into the unfinished metal shell 50*a*, the ring member 7 is arranged between the inner-shaft-attached insulator 102 and the unfinished metal shell 50*a*, and then, the talc 9 is filled into the space between the inner-shaft-attached insulator 102 and the unfinished metal shell 50*a*, as shown in FIG. 2(*b*). At this time, the talc 9 is filled to a point adjacent a rear end of the cylindrical portion 53*a*.

After the arrangement of the ring member 7 and the filling of the talc 9, the talc 9 is pressed from the upper side in the axial direction OD and then compressed in the axial direction OD. When the ring member 7 and the talc 9 are pressed in the axial direction OD, the inner-shaft-attached insulator 102 is pushed toward the front in the unfinished metal shell 50*a* and assembled in the unfinished metal shell 50*a*. After that, the ring member 6 is arranged on an upper end of the talc 9.

After the process step of FIG. 2, the unfinished metal shell 50*a* is subjected to crimping, thereby forming the metal shell 50 with the crimped portion 53 and the buckled portion 58. Namely, it can be said that the process step of FIG. 2 corresponds to a step of assembling the inner-shaft-attached insulator 102 into the metal shell 50.

Figure 3:
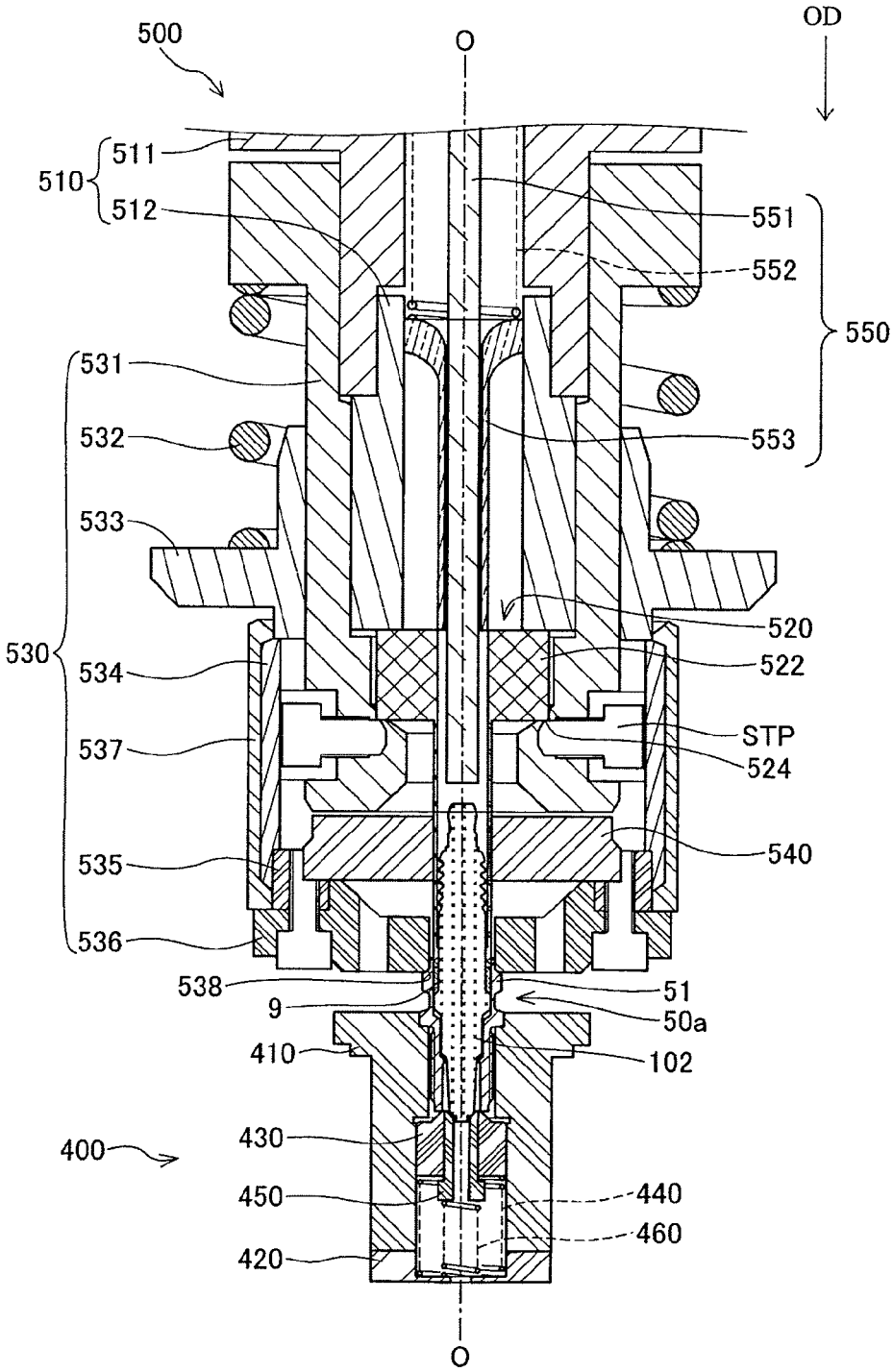
FIG. 3 is a section view of an assembling apparatus for assembling an inner-shaft-attached insulator into an unfinished metal shell according to one embodiment of the present invention.

FIG. 3 is a section view of an assembling apparatus for assembling the inner-shaft-attached insulator 102 into the unfinished metal shell 50*a*. As shown in FIG. 3, the unfinished metal shell 50*a* in which the inner-shaft-attached insulator 102 has been inserted with the talc 9 filled therebetween is placed on an assembling seat 400 of the assembling apparatus. The talc 9 is pressed from the upper side by a talc press device 500 of the assembling apparatus. In FIG. 3, the ring member 7 is omitted for convenience in explanation.

The assembling seat 400 has a receiving die 410, a seat bottom 420, a shell restriction member 430, an outer spring 440 that biases the shell restriction member 430 toward the upper side, an insulator restriction member 450 and an inner spring 460 that biases the insulator restriction member 450 toward the upper side. Among these structural parts, the receiving die 410, the seat bottom 420, the shell restriction member 430, the outer spring 440 and the inner spring 460 are each formed of a high-strength metal material such as tool steel. On the other hand, the insulator restriction member 450, with which the ceramic insulator 10 is brought into contact as will be explained later, is preferably formed of a resin in order to prevent contamination of the ceramic insulator 10.

The outer spring 440 is held in contact with the seat bottom 420 to apply a load, which is greater than the weight of the unfinished metal shell 50*a*, to the shell restriction member 430 and thereby force the shell restriction member 430 toward the upper side. Thus, the unfinished metal shell 50*a* is in a state of being floated from the receiving die 410. Further, the inner spring 460 is held in contact with the seat bottom 420 to apply a load, which is greater than the weight of the inner-shaft-attached insulator 102, to the insulator restriction member 450 and thereby force the insulator restriction member 450 toward the upper side. The inner-shaft-attached insulator 102 is thus in a state of being floated from the unfinished metal shell 50*a*. Although the shell restriction member 430 and the insulator restriction member 450 are biased by the springs 440 and 460 toward the upper side (i.e. toward the rear) in the first embodiment, it is alternatively feasible to bias the shell restriction member 430 and the insulator restriction member 450 by any other means. For example, rubber members or air springs may be used in place of the springs 440 and 460 to bias the shell restriction member 430 and the insulator restriction member 450. In general, the shell restriction member 430 and the insulator restriction member 450 can be biased by various elastic members.

The talc press device 500 has a load transmission unit 510 that transmits a press load, a press jig 520 that presses the talc 9, a holding unit 530 that holds the unfinished metal shell 50*a*, a guide member 540 that limits movement of the press jig 520 in the axis O-O direction and a detachment mechanism 550 that allows the unfinished metal shell 50*a* to be detached from the talc press device 500 after the assembling. The detachment mechanism 550 is made up of three structural parts 551 to 553. The respective component parts of the assembling apparatus can be each formed of a high-strength metal material such as tool steel. As the operation and function of the detachment mechanism 550 are not pertinent to the present invention, explanations of the operation and function of the detachment mechanism 550 will be omitted herefrom.

The load transmission unit 510 includes a press load receiving portion 511 that receives a load directly from a press machine and a transfer portion 512 that transfers the load from the press load receiving portion 511 to the press jig 520. The load applied to the press load receiving portion 511 in the axial direction OD is transferred to press jig 520 through the transfer portion 512.

The holding unit 530 includes a spring press portion 531, a spring 532, a spring receiving portion 533, a spring force transfer portion 534, a guide holding portion 535 that holds the guide member 540, a shell contact portion 536 and an outer periphery holding portion 537 that holds an outer periphery of the spring force transfer portion 534. The guide member 540 is adapted to limit the direction of movement of the press jig 520 to the axis O-O direction and secured to the guide holing portion 535 by screws.

A stopper STP is secured to the spring press portion 531 by screws. Upon contact of a front end 524 of a large-diameter portion 522 of the press jig 520 with the stopper STP, a load is applied to the spring press portion 531 in the axial direction OD. The load applied to the spring press portion 531 is transmitted to the shell contact portion 536 through the spring 532, the spring receiving portion 533, the spring force transfer portion 534 and the guide holding portion 535. A tapered surface 538 is formed in the center of the front end of the shell contact portion 536.

When the rear end of the tool engagement portion 51 of the unfinished metal shell 50*a* is brought into contact with the tapered surface 538, a load is applied in the axial direction OD to the unfinished metal shell 50*a* floated on the receiving die 410 of the assembling seat 400 so as to push the unfinished metal shell 50*a* against the shell restriction member 430. The unfinished metal shell 50*a* is thus moved toward the lower side and pushed against the receiving die 410 while the front end position of the unfinished metal shell 50*a* is restricted by the shell restriction member 430.

Further, when the talc 9 is pressed by the press jig 520, a load is applied in the axial direction OD to the inner-shaft-attached insulator 102 floated on the unfinished metal shell 50*a*. The inner-shaft-attached insulator 102 is thus moved toward the lower side and pushed into the unfinished metal shell 50*a* while the front end position of the inner-shaft-attached insulator 102 is restricted by the insulator restriction member 450.

Figure 5:
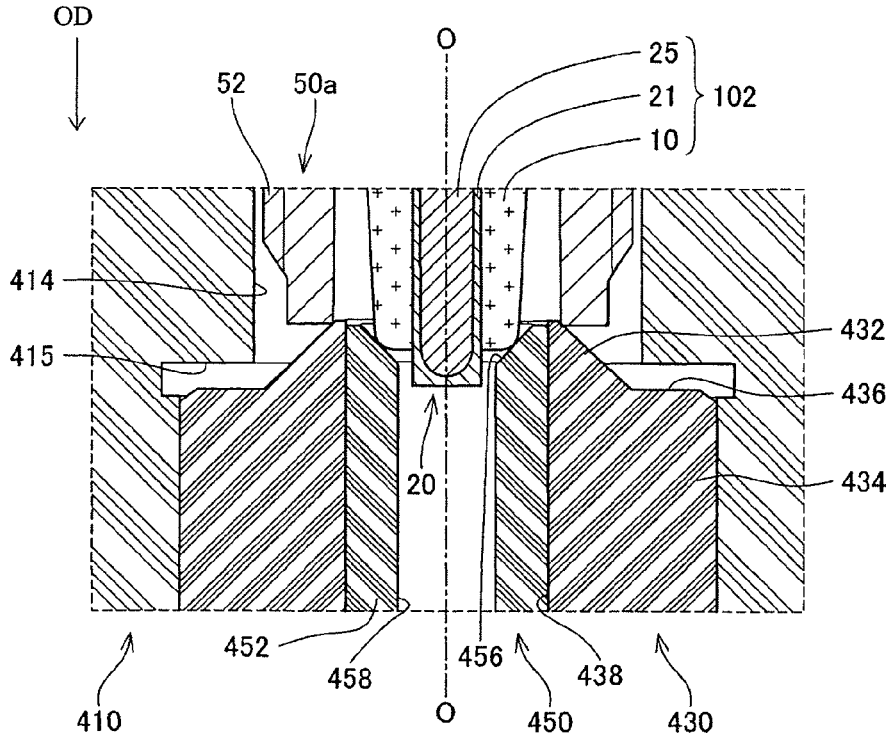
FIG. 5 is an enlarged section view of a cut-away portion of FIG. 4.

FIG. 4 is an enlarged section view of the assembling seat 400 and the press jig 520. FIG. 5 is an enlarged section view of a cut-away portion of FIG. 4. In FIG. 4, the ring members 6 and 7 are omitted for convenience in explanation.

The receiving die 410 of the assembling seat 400 includes flange portions 417 and 418 having different outer diameters in the axial direction OD and a body portion 419 having an outer diameter smaller than that of the flange portion 418. The receiving die 410 is fixed by the flange portions 417 and 418 in the assembling apparatus. The receiving die 410 also includes a shell receiving portion 412 formed in an upper side of the flange portion 417 and having an inner diameter substantially equal to the outer diameter of the seal portion 54 of the unfinished metal shell 50*a* and an insertion portion 414 extending through substantially the centers of the flange portions 417 and 418 to the body portion 419 and having an inner diameter larger than the outer diameter of the mounting thread portion 52 of the unfinished metal shell 50*a*. Further, a guide hole 416 is formed in the body portion 419 with an inner diameter larger than that of the insertion portion 414.

The seat bottom 420 is adapted to receive thereon the outer spring 440 and includes an annular portion 422 having an outer diameter substantially equal to that of the body portion 419 of the receiving die 410 and a plate portion 424 extending at a lower end thereof radially inwardly from the annular portion 422. A through hole 426 is formed in the center of the plate portion 424, with an inner diameter smaller than that of the inner spring 460, so as to prevent increase in pressure during the insertion of the unfinished metal shell 50*a* and during the assembling of the inner-shaft-attached insulator 102. The seat bottom 420 is fixed to the receiving die 410 by screws etc. although not so shown in the drawing.

The shell restriction member 430 includes a tapered portion 432 formed on a side thereof adjacent to the unfinished metal shell 50*a* (i.e. at an upper side thereof) and having an outer diameter gradually increasing in the axial direction OD (i.e. toward the lower side in FIG. 3) and a body portion 434 having an outer diameter substantially equal to the inner diameter of the guide hole 416 of the receiving die 410. The shell restriction member 430 is thus movable relative to the receiving die 410 in the axis O-O direction. An upper end face 436 of the body portion 434 is aligned perpendicular to the axis O-O so that the upper limit position of the shell restriction member 430 is determined by contact of the upper end face 436 with a lower end face 415 of the insertion portion 414. A guide hole 438 is formed in the shell restriction member 430 along the axis O-O for insertion of the insulator restriction member 450.

The insulator restriction member 450 is cylindrical in shape and includes a cylindrical body portion 452 having an outer diameter substantially equal to the inner diameter of the guide hole 438 of the shell restriction member 430 and a flange portion 454 formed on a lower side of the body portion 452. The insulator restriction member 450 is movable relative to the shell restriction member 430 in the axis O-O direction as the outer diameter of the body portion 452 is made substantially equal to the inner diameter of the guide hole 438. As the flange portion 454 is formed on the lower side of the body portion 452, the upper limit position of the insulator restriction member 450 relative to the shell restriction member 430 is determined by contact of the flange portion 454 with the shell restriction member 430. The insulator restriction member 450 has a tapered hole 456 formed in a side thereof adjacent to the inner-shaft-attached insulator 102 (i.e. at an upper side thereof) and having an inner diameter gradually decreasing in the axial direction OD (i.e. toward the lower side in FIG. 3). A through hole 458 is also formed in the insulator restriction member 450 with a substantially constant inner diameter.

The tapered portion 432 is formed on the shell restriction member 430 at a location adjacent to the unfinished metal shell 50*a* in such a manner that the outer diameter of the tapered portion 432 gradually increases in the axial direction OD. At the time of assembling the inner-shaft-attached insulator 102 in the unfinished metal shell 50*a*, the position of the front end portion of the unfinished metal shell 50*a* is restricted in the radial direction by contact of the front end portion of the unfinished metal shell 50*a* with the tapered portion 432 of the shell restriction member 430. The center of the front end portion of the unfinished metal shell 50*a* is thus aligned on the axis O-O after the assembling. Further, the tapered hole 456 is formed in the insulator restriction member 450 at a location adjacent to the inner-shaft-attached insulator 102 in such a manner that the inner diameter of the tapered hole 456 gradually decreases in the axial direction OD. The position of the front end portion of the inner-shaft-attached insulator 102 is restricted in the radial direction by contact of the ceramic insulator 10, i.e., the front end portion of the inner-shaft-attached insulator 102 with the tapered hole 456 of the insulator restriction member 450 at the time of assembling the inner-shaft-attached insulator 102 in the unfinished metal shell 50*a*. The center of the front end portion of the inner-shaft-attached insulator 102 is thus aligned on the axis O-O after the assembling.

As explained above, the inner-shaft-attached insulator 102 and the unfinished metal shell 50*a* are assembled together by displacing the inner-shaft-attached insulator 102 and the unfinished metal shell 50*a* along the axis O-O while limiting the relative displacement of the inner-shaft-attached insulator 102 and the unfinished metal shell 50*a* in the radial direction in the first embodiment. As a result, the center of the front end portion of the inner-shaft-attached insulator 102 and the center of the front end position of the unfinished metal shell 50*a* can be substantially aligned with each other after the assembling. As the inner-shaft-attached insulator 102 is cylindrical in shape, the electrode tip on the front end of the center electrode 10 can be protected from damage during the assembling.

As shown in FIG. 5, both of the outer surface of the tapered portion 432 of the shell restriction member 430 and the inner surface of the tapered hole 456 of the insulator restriction member 450 are conical in shape in the first embodiment. The outer surface of the tapered portion 432 and the inner surface of the tapered hole 456 are not however limited to the conical shapes and can be of various shapes as long as the outer diameter of the outer surface of the tapered portion 432 increases in the specific direction (axial direction OD) and as long as the inner diameter of the inner surface of the tapered hole 456 decreases in the specific direction. For example, the outer surface of the tapered portion 432 may be formed into a tapered surface with a cylindrical surface area so as to fit with the outer surface of the front end portion of the metal shell 50. The inner surface of the tapered hole 456 may be formed into a tapered surface with a conical surface area and a curved surface area so as to fit with the outer surface of the front end portion of the ceramic insulator 10. It is however preferable that the tapered surface is conical in shape for ease of radial position control.

A3. Comparative Example

FIG. 6 is a process chart showing a process step for assembling an inner-shaft-attached insulator 102 in an unfinished metal shell 50*a* by means of an assembling seat 400*b* according to a comparative example. The assembling seat 400*b* of the comparative example is different from the assembling seat 400 of the first embodiment, in that the assembling seat 400*b* has a single restriction member 470 and a single spring 480 incorporated in between the receiving die 410 and the seat bottom 420. In the comparative example, the positional displacements of the inner-shaft-attached insulator 102 and the unfinished metal shell 50*a* in the radial direction are restricted by such a single restriction member 470 and such a single spring 480. The other configurations of the comparative example are the same as those of the first embodiment.

The restriction member 470 includes a tapered portion 472 having an outer diameter gradually increasing in the axial direction OD and an inner diameter gradually decreasing in the axial direction OD, a flange portion 474 having an outer diameter substantially equal to the inner diameter of the guide hole 416 and a body portion 476 located between the tapered portion 472 and the flange portion 474. In the comparative example, the restriction member 470 is movable along the axis O-O and is biased toward the upper side by the spring 480.

When the inner surface of the front end portion of the unfinished metal shell 50*a* and the outer surface of the front end portion of the inner-shaft-attached insulator 102 are simultaneously brought into contact with the tapered portion 472 of the restriction member 470, both of the front end portion of the unfinished metal shell 50*a* and the front end portion of the inner-shaft-attached insulator 102 are restricted in the radial direction such that the center of the front end portion of the unfinished metal shell 50*a* and the front end portion of the inner-shaft-attached insulator 102 are aligned on the axis O-O. However, there is a case that the inner surface of the front end portion of the unfinished metal shell 50*a* and the outer surface of the front end portion of the inner-shaft-attached insulator 102 may not be simultaneously brought into contact with the tapered portion 472 of the restriction member 470 due to an error in the shape of the inner-shaft-attached insulator 102, the unfinished metal shell 500, the plate packing 8 etc. In such a case, either the inner surface of the front end portion of the unfinished metal shell 50*a* or the outer surface of the front end portion of the inner-shaft-attached insulator 102 is not restricted in the radial direction. This causes a deviation of the center of the front end portion of the unfinished metal shell 50*a* or the outer surface of the front end portion of the inner-shaft-attached insulator 102 from the axis O-O.

Figure 7:
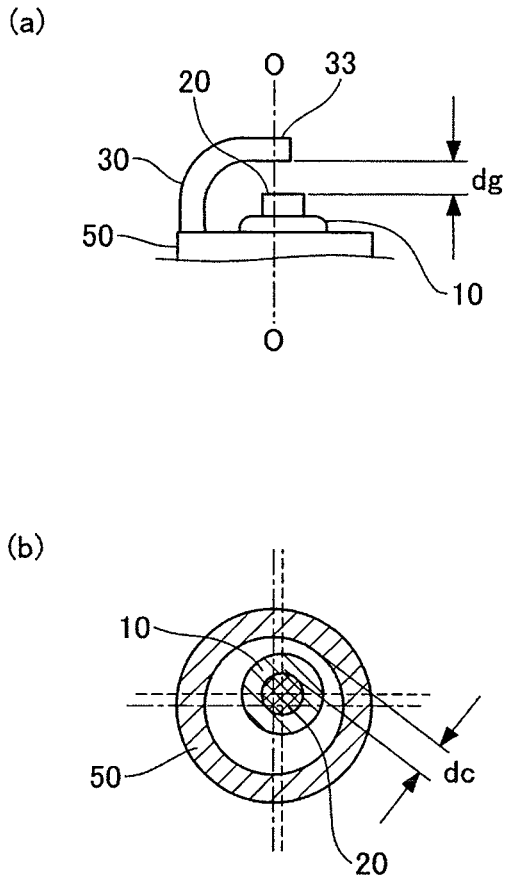
FIG. 7 is a schematic view showing a state in which there occurs a deviation between the center of the inner-shaft-attached insulator and the center of the unfinished metal shell.

FIG. 7 is a schematic view showing an off-center state in which there occurs a deviation between the center of the front end portion of the inner-shaft-attached insulator 102 and the center of the front end portion of the unfinished metal shell 50, wherein FIG. 7(*a*) shows the appearance of part of the spark plug 100 in the off-center state as viewed from the side; and FIG. 7(*b*) shows the front end positions of the center electrode 20, the ceramic insulator 10 and the metal shell 50 in the off-center state. In FIG. 7(*b*), the center of the metal shell 50 is indicated by a dot-dash line; and the centers of the center electrode 20 and the ceramic insulator 10 (inner-shaft-attached insulator) are indicated by broken likes.

As shown in FIG. 7(*a*), the distance (spark gap) dg between the front end portion of the center electrode 20 and the front end portion 33 of the ground electrode 30 is set to a given dimension. On the other hand, the minimum distance dc between the center electrode 20 and the metal shell 50 decreases as the center of the center electrode 20 and the center of the metal shell 50 are deviated from each other. When the difference between these distances dg and dc becomes small, there is a high possibility that the spark plug generates a spark discharge between the center electrode 20 and the metal shell 50 rather than between the center electrode 20 and the front end portion 33 of the ground electrode 30. The generation of the spark discharge between the center electrode 20 and the metal shell 50 results in failure of proper ignition in the internal combustion engine. Further, there is a possibility that the center electrode 20 and the metal shell 50 may become worn due to the generation of the spark discharge between the center electrode 20 and the metal shell 50.

In the first embodiment, by contrast, the center of the front end portion of the ceramic insulator 10 and the center of the front end portion of the metal shell 50 can be kept substantially aligned on the axis O-O. As the center of the center electrode 20 is substantially in agreement with the center of the ceramic insulator 10, the center of the center electrode 20 is substantially in agreement with the center of the front end portion of the metal shell 50. The distance dc between the center electrode 20 and the front end portion of the metal shell 50 can be thus maintained at a sufficient level. It is accordingly possible in the first embodiment to prevent the generation of a spark plug between the center electrode 20 and the inner surface of the metal shell 50 and attain assured proper ignition in the internal combustion engine and reduction of wear in the spark plug 100.

B. Second Embodiment

Figure 8:
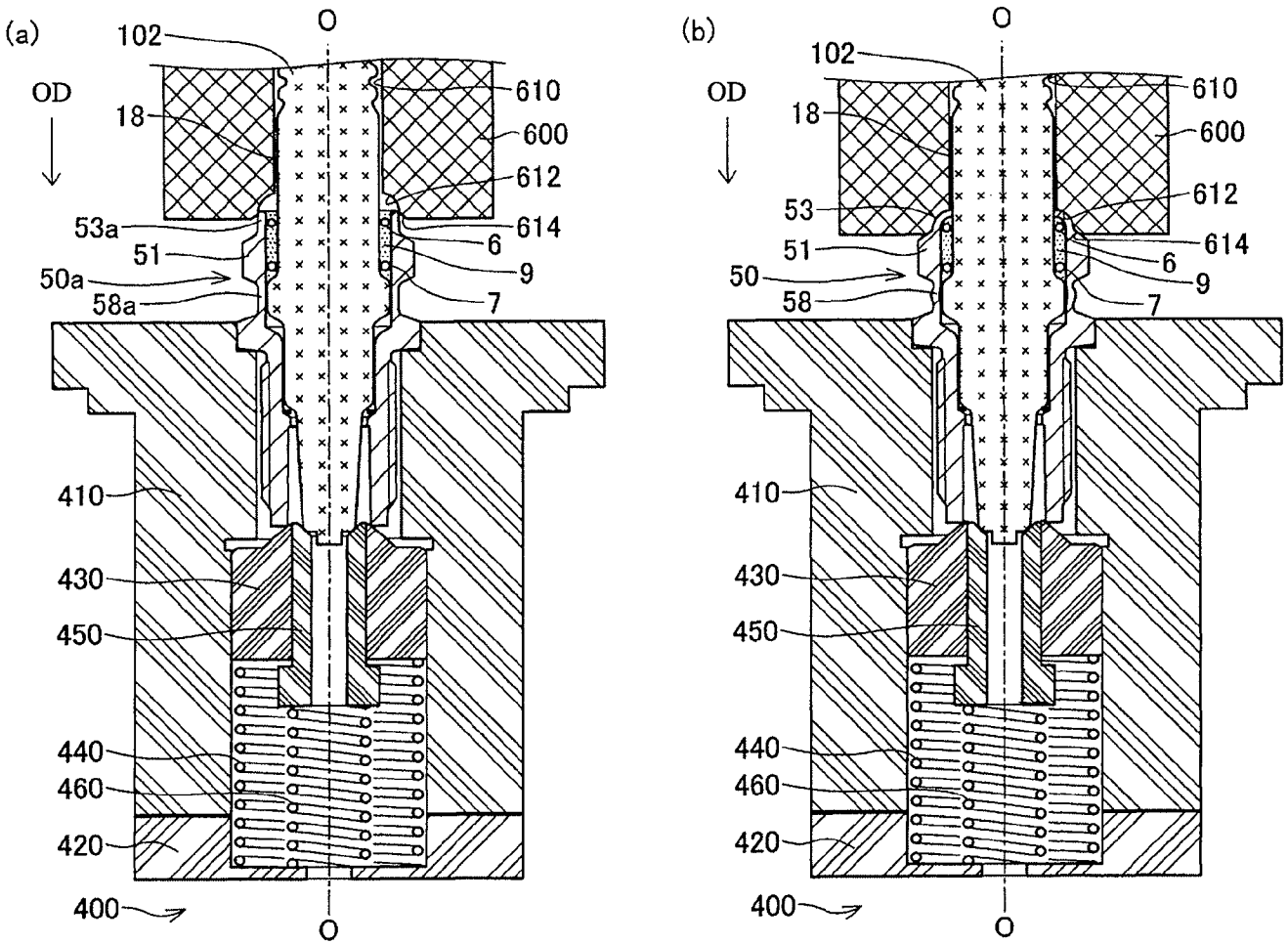
FIG. 8 is a process chart showing a process step for assembling an inner-shaft-attached insulator into an unfinished metal shell according to another embodiment of the present invention.

FIG. 8 is process chart showing a process step for assembling the inner-shaft-attached insulator 102 in the unfinished metal shell 50*a* according to a second embodiment of the present invention. In the process step of FIG. 8, the unfinished metal shell 50*a* in which the inner-shaft-attached insulator 102 has been inserted is subjected to crimping. This crimping step is performed by, after placing the unfinished metal shell 50*a* in which the inner-shaft-attached insulator 102 has been inserted on the assembling seat 400, pressing a crimp tool 600 onto the unfinished metal shell 50*a* in the axial direction OD from the upper side.

The crimp tool 600 is cylindrical in shape. A through hole 610 is formed in the crimp tool 600 with an inner diameter larger than the outer diameter of the rear body portion 18 of the ceramic insulator 10 (FIG. 1), which constitutes the inner-shaft-attached insulator 102. The crimp tool 600 has a curved surface portion 612 formed at a lower edge (i.e. front edge) of the through hole 610 and shaped to fit with the outer surface of the crimped portion 53 and a contact portion 614 formed around an outer periphery of the curved surface portion 612 and shaped to fit with the outer surface of the rear end of the tool engagement portion 51.

As shown in FIG. 8(*a*), a load is applied in the axial direction OD to the unfinished metal shell 50*a* so as to push the unfinished metal shell 50*a* against the shell restriction member 430 when the curved surface portion 612 is brought into contact with the upper cylindrical portion 53*a* of the unfinished metal shell 50*a*. The unfinished metal shell 50*a* is thus moved toward the lower side and pushed against the receiving die 410 while the front end position of the unfinished metal shell 50*a* is restricted by the shell restriction member 430.

The cylindrical portion 53*a* is bent along the curved surface portion 612 of the crimp tool 600 by pressing the crimp tool 600 onto the unfinished metal shell 50*a* in the axial direction OD while pushing the unfinished metal shell 50*a* against the receiving die 410, thereby forming the crimped portion 53. The contact portion 614, which is formed around the outer periphery of the curved surface portion 612, is brought into contact with the tool engagement portion 51 when the crimp tool 600 is further moved to the lower side after the formation of the crimped portion 53. A load is then applied to the tool engagement portion 51 so as to buckle the cylindrical portion 58*a* on the lower side of the tool engagement portion 51, thereby forming the buckled portion 58.

In this crimping step, the talc 9 and the ring members 6 and 7 are pressed in the axial direction OD so as to apply a load in the axial direction OD to the inner-shaft-attached insulator 102 through the flange portion 19 of the ceramic insulator 10. By the application of the load to the inner-shaft-attached insulator 102 in the axial direction OD, the inner-shaft-attached insulator 102 is pushed against the insulator restriction member 50. The inner-shaft-attached insulator 102 is then moved toward the lower side and assembled in the unfinished metal shell 50*a* while the front end position of the inner-shaft-attached insulator 102 is restricted by the insulator restriction member 450.

As explained above, the inner-shaft-attached insulator 102 and the unfinished metal shell 50*a* are assembled together in such a manner that the center of the front end portion of the inner-shaft-attached insulator 102 and the center of the front end portion of the metal shell 50 are substantially aligned on the axis O-O in the second embodiment as in the case of the first embodiment. The center of the center electrode 20 (FIG. 1) is thus substantially in agreement with the center of the front end portion of the metal shell 50 (FIG. 1) so that the distance between the center electrode 20 and the front end portion of the metal shell 50 can be maintained at a sufficient level. It is therefore possible to prevent the generation of a spark discharge between the center electrode 20 and the inner surface of the metal shell 50 and attain assured proper ignition in the internal combustion engine and reduction of wear in the spark plug 100.

DESCRIPTION OF REFERENCE NUMERALS

3: Ceramic resistor
4: Seal member
5: Gasket
6, 7: Ring member
8: Plate packing
9: Talc
10: Ceramic insulator
11: Knurls
12: Axial hole
13: Leg portion
15: Step portion
17: Front body portion
18: Rear body portion
19: Flange portion
20: Center electrode
21: Electrode body
25: Core
30: Ground electrode
33: Front end portion
40: Metal terminal
50: Metal shell
50*a*: Unfinished metal shell
51: Tool engagement portion
52: Mounting thread portion
53: Crimped portion
53*a*: Cylindrical portion
54: Seal portion
55: Bearing surface
56: Step portion
58: Buckled portion
58*a*: Cylindrical portion
59: Thread neck
100: Spark plug
102: Inner-shaft-attached insulator
200: Engine head
201: Mounting thread hole
205: Opening edge
400, 400*b*: Assembling seat
410: Receiving die
412: Shell receiving portion
414: Insertion portion
415: Lower end face
416: Guide hole
417, 418: Flange portion
419: Body portion
420: Seat bottom
422: Annular portion
424: Plate portion
426: Through hole
430: Shell restriction member
432: Tapered portion
434: Body portion 4
436: Upper end face
438: Guide hole
440: Outer spring
450: Insulator restriction member
452: Body portion
454: Flange portion
456: Tapered hole:
458: Through hole
460: Inner spring
470: Restriction member
472: Tapered portion
474: Flange portion
476: Body portion
480: Spring
500: Talc press device
510: Load transmission unit
511: Press load receiving portion
512: Transfer portion
520: Press jig
522: Large-diameter portion
524: Front end
530: Holding unit
531: Spring press portion
532: Spring
533: Spring receiving portion
534: Spring force transfer portion
535: Guide holding portion
536: Shell contact portion
537: Outer periphery holding portion
538: Tapered surface
540: Guide member
550: Detachment mechanism
600: Crimp tool
610: Through hole
612: Curved surface portion
614: Contact portion
STP: Stopper

The invention claimed is:

1. A manufacturing method of a spark plug, the spark plug comprising: a center electrode; an insulator having an axial hole extending in an axial direction of the center electrode and retaining the center electrode in a front side of the axial hole in the axial direction; and a cylindrical metal shell surrounding and retaining therein the insulator, the manufacturing method comprising: assembling the insulator in the metal shell by inserting the insulator from an open rear end of the metal shell in the axial direction, wherein said assembling of the metal shell and the insulator includes limiting relative positional displacement between the metal shell and the insulator in a radial direction intersecting with the axial direction in such a manner that the amount of deviation between an axis of the metal shell and an axis of the insulator becomes less than or equal to a predetermined level while allowing relative positional displacement between the metal shell and the insulator in the axial direction, and wherein said limiting includes: providing a first positioning member; bringing a front end portion of the metal shell in the axial direction into contact with the first positioning member to thereby limit displacement of the metal shell in the radial direction; providing a second positioning member movable relative to the first positioning member along the axial direction; and bringing a front end portion of the insulator in the axial direction into contact with the second positioning member to thereby limit displacement of the insulator in the radial direction.

2. The manufacturing method of the spark plug according to claim 1, wherein the first positioning member has a first tapered surface that increases in outer diameter toward the front in the axial direction; wherein the second positioning member has a second tapered surface that decreases in inner diameter toward the front in the axial direction; and wherein the front end portion of the metal shell and the front end portion of the insulator are brought into contact with the first and second tapered surfaces, respectively.

3. The manufacturing method of the spark plug according to claim 2, wherein at least one of the first and second tapered surfaces is conical in shape.

4. The manufacturing method of the spark plug according to claim 1, wherein the second positioning member is formed of a resin.

5. The manufacturing method of the spark plug according to claim 1, wherein the first and second positioning members are biased by elastic members toward the rear in the axial direction.

6. The manufacturing method of the spark plug according to claim 5, wherein the elastic members are springs.

7. The manufacturing method of the spark plug according to claim 1, wherein said assembling includes filling a talc in a space between the metal shell and the insulator and pressing the talc toward the front in the axial direction.

8. The manufacturing method of the spark plug according to claim 1, wherein said assembling includes crimping the open rear end of the metal shell to thereby retain the insulator in the metal shell.

9. A spark plug manufactured by the manufacturing method according to claim 1.

10. A manufacturing apparatus of a spark plug, the spark plug comprising: a center electrode; an insulator having an axial hole extending in an axial direction of the center electrode and retaining the center electrode in a front side of the axial hole in the axial direction; and a cylindrical metal shell surrounding and retaining therein the insulator, the manufacturing apparatus being configured to assemble the insulator in the metal shell by inserting the insulator from an open rear end of the metal shell in the axial direction, the manufacturing apparatus comprising:

a first positioning member that allows positioning of the metal shell in a radial direction intersecting with the axial direction;

a second positioning member that allows positioning of the insulator in the radial direction, the first and second positioning members being movable relative to each other in the axial direction and adapted to limit relative positional displacement of the metal shell and the insulator in the radial direction in such a manner that the amount of deviation between an axis of the metal shell and an axis of the insulator becomes less than or equal to a predetermined level while allowing relative positional displacement between the metal shell and the insulator in the axial direction.

11. The manufacturing apparatus of the spark plug according to claim 10, wherein the first positioning member has a first tapered surface that increases in outer diameter toward the front in the axial direction; and wherein the second positioning member has a second tapered surface that decreases in inner diameter toward the front in the axial direction.

12. The manufacturing apparatus of the spark plug according to claim 11, wherein at least one of the first and second tapered surfaces is conical in shape.

13. The manufacturing apparatus of the spark plug according to claim 10, wherein the second positioning member is formed of a resin.

14. The manufacturing apparatus of the spark plug according to claim 10, further comprising elastic members that bias the first and second positioning member toward the rear in the axial direction.

15. The manufacturing apparatus of the spark plug according to claim 14, wherein the elastic members are springs.

16. The manufacturing apparatus of the spark plug according to claim 10, further comprising a unit for assembling the insulator in the metal shell by filling a talc in a space between the metal shell and the insulator and pressing the talc toward the front in the axial direction.

17. The manufacturing apparatus of the spark plug according to claim 10, further comprising a unit for assembling the insulator in the metal shell by crimping the open rear end of the metal shell.

* * * * *